US006926555B2

(12) United States Patent
Nelson

(10) Patent No.: US 6,926,555 B2
(45) Date of Patent: Aug. 9, 2005

(54) TUNED RADIO FREQUENCY COAXIAL CONNECTOR

(75) Inventor: James W Nelson, Cheshire, CT (US)

(73) Assignee: Radio Frequency Systems, Inc., Meriden, CT (US)

( * ) Notice: Subject to any disclaimer, the term of this patent is extended or adjusted under 35 U.S.C. 154(b) by 0 days.

(21) Appl. No.: 10/681,220

(22) Filed: Oct. 9, 2003

(65) Prior Publication Data

US 2005/0079759 A1 Apr. 14, 2005

(51) Int. Cl.[7] ..... H01R 29/00
(52) U.S. Cl. ..... 439/578
(58) Field of Search ..... 439/578, 579–585, 439/63, 675, 805, 98, 99, 610, 620; 174/88 C, 84 R, 88.2; 29/828, 858

(56) References Cited

U.S. PATENT DOCUMENTS 3,663,901 A 5/1972 Forney, Jr.
4,022,518 A * 5/1977 Gattaz ..... 439/28
4,153,885 A 5/1979 Bacher
4,773,871 A * 9/1988 Behning ..... 439/181
5,167,533 A 12/1992 Rauwolf
5,518,420 A * 5/1996 Pitschi ..... 439/578
5,831,215 A * 11/1998 Ziemek et al. ..... 174/108
5,982,251 A 11/1999 Weinschel et al.
6,057,510 A 5/2000 Acke

* cited by examiner

*Primary Examiner*—Alexander Gilman
(74) *Attorney, Agent, or Firm*—V. Lawrence Sewell; Sughrue Mion, PLLC

(57) ABSTRACT

A tuned RF coaxial connector for mating a coaxial transmission line includes a cylindrical outer conductor, a coupling mechanism for mating the coaxial transmission line to the substantially cylindrical outer conductor, and an inner conductor extending coaxially within cylindrical outer conductor. One end of the cylindrical outer conductor interfits with the coaxial transmission line and another end of the cylindrical outer conductor interfits with an electrical device. The connector has an open circuit inner stub where the inner conductor of the transmission line couples to the inner conductor of the connector, or an open circuit outer stub where the outer conductor of the transmission line couples to the outer body of the connector, or both. Without the need for precise fitting of the conductors of the coaxial transmission line and the connector, the invention facilitates field installation of cables and connectors while reducing implementation cost.

21 Claims, 7 Drawing Sheets

TUNED RADIO FREQUENCY COAXIAL CONNECTOR

BACKGROUND OF THE INVENTION

1. Field of the Invention

This invention relates to a connector for a coaxial transmission line used for limited bandwidth. More particularly, the invention relates to a connector for connecting coaxial transmission lines over a specified RF band by the use of a coaxial open circuit stub section.

2. Description of the Related Art

Currently, coaxial connectors use a spring-type contacts for connecting to the inner conductor of a coaxial transmission line and a clamp for connecting to the outer conductor of the coaxial transmission line. These metal-to-metal electrical contacts known in the art provide an extension of the signal path in a broad frequency range. Such connectors are generally made of costly materials and are designed in a way that excessive force is exerted on the cable conductors to eliminate the poor contact of conductors. Such a design solution requires cables with thicker conductors to withstand the contact force and to ensure proper electrical contact. Consequently, the cost of the cables as well as the connectors is relatively high. Further, such connectors require specific installation requirements, such as torque levels, to apply the proper contact force between the conductors. A field service technician may have a difficult time fulfilling installation requirements in adverse weather conditions which require the use of gloves. If the field installation requirements are not met, then electrical contact may be lost, resulting in the inability to properly transmit the signals.

In certain applications, however, only signals within a specified frequency band are transmitted and thus do not require broadband connectors. To properly transmit these signals, costly materials or designs providing metal-to-metal electrical contacts are not necessary.

SUMMARY OF THE INVENTION

A coaxial electrical connector for mating a coaxial transmission line having a center conductor and an outer conductor with an electrical device is disclosed. The connector includes a substantially cylindrical outer conductor having spaced first and second end portions, an elongate central portion intermediate said end portions, said cylindrical outer conductor having an axial bore therethrough, and a dielectric insulator fixed within said bore at said center portion.

The connector also includes a coupling mechanism mating said coaxial transmission line to said substantially cylindrical outer conductor, and an inner conductor within said insulator and extending coaxially within the bore, said inner conductor having first and second end portions corresponding to said first and second end portions of said cylindrical outer conductor and a central portion corresponding to said central portion of said cylindrical outer conductor.

The first end portions of the inner conductor interfits with the coaxial transmission line such that said first end portion of said inner conductor mates with the center conductor of the coaxial transmission line, said first end portion of said cylindrical outer conductor mates with the outer conductor of the coaxial transmission line. Additionally, said second end portions are mateable with the electrical device. Moreover, a dielectric member is disposed between (1) the first end portion of the inner conductor of the connector and the center conductor of the coaxial transmission line, or between (2) the first end portion of the cylindrical outer conductor of the connector and the outer conductor of the coaxial transmission line, or (3) both, so as to prevent a direct electrical contact therebetween.

In another embodiment, the inner conductor of the connector is coupled inside a hollow center conductor of the coaxial transmission line.

In yet another embodiment, a solid center conductor of the coaxial transmission line is coupled inside a hollow inner conductor of the connector.

In an alternative embodiment, a shunt short circuit stub is disposed to provide an electrical connection between the inner and the outer conductor of the connector.

In another alternative embodiment, an outer choke is disposed in the cylindrical outer conductor of the connector.

In yet another alternative embodiment, the outer conductor of the connector is coupled inside the outer conductor of the coaxial transmission line.

BRIEF DESCRIPTION OF THE DRAWINGS

Other features and advantages of the present invention will be apparent from the following description taken in connection with the accompanying drawings, wherein.

DETAILED DESCRIPTION OF THE PREFERRED EMBODIMENTS

In a preferred embodiment of the invention, a transmission line is coupled to a connector, wherein the connector comprises a cylindrical outer conductor body, a dielectric insulator, an inner conductor within the dielectric insulator, and a series open circuit inner stub and a series open circuit outer stub at an end of the connector coupled to the connector. Although the preferred embodiment is described below in FIG. 4, an exemplary first embodiment will now be described with reference to FIG. 1.

Figure 1:
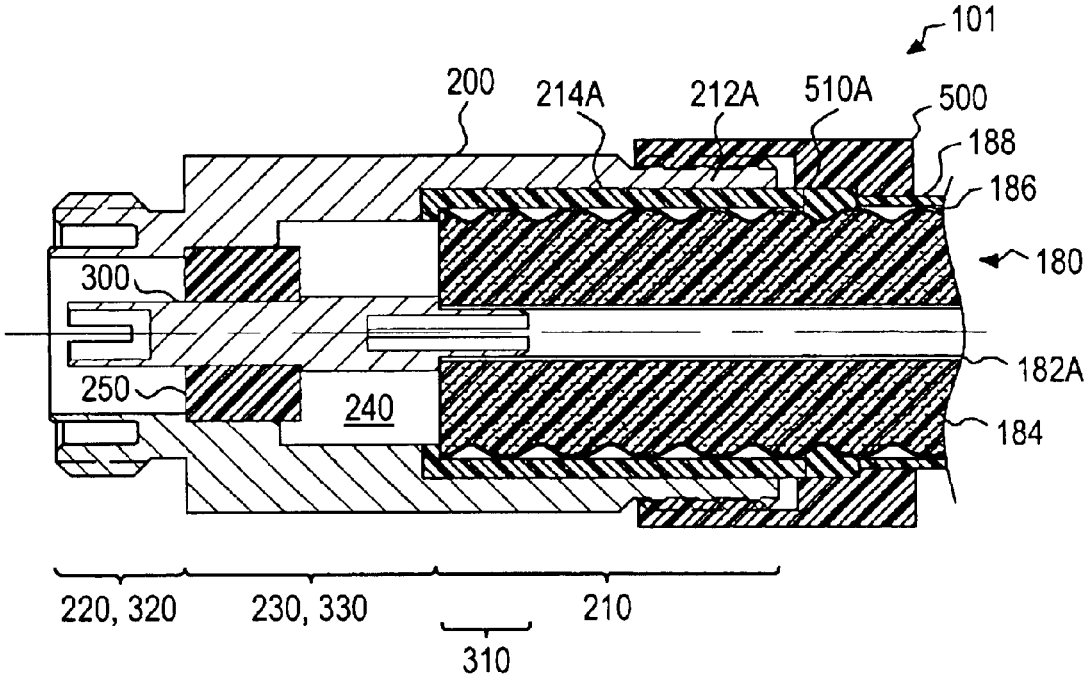
FIG. 1 is a cross sectional view of an embodiment of the invention showing a series open circuit outer stub.

A cross sectional view of a tuned RF coaxial connector 101 is shown in FIG. 1. The connector 101 is connected to a coaxial transmission line 180.

The coaxial transmission line 180 includes a typically smooth hollow tube center conductor 182A surrounded by an insulation 184 with a dielectric constant $\epsilon_1$. The insulation 184 is made of any suitable dielectric, including, for example, solid polyethylene, foamed polyethylene, TEFLON (polytetrafluoroethylene), fluorinated ethylene propylene, and foamed fluorinated ethylene propylene, or any material in combination with air. The dielectric provides support to maintain the inner conductor on the axis of cable. Surrounding the insulation 184 is an outer conductor 186. The outer conductor 186 is typically made of an annular corrugated copper sheet to provide flexibility and ease in attaching standard connectors. Surrounding the outer conductor 186 is a protective cover 188.

The coaxial transmission line 180 is coupled to the connector 101. The connector 101 comprises a substantially cylindrical outer conductor 200 having spaced first end portion 210, second end portion 220, and an elongate central portion 230. The elongate central portion 230 is disposed between the first end portion 210 and the second end portion 220, and has an axial bore 240 therethrough. Additionally, there is a dielectric bead 250 with a dielectric constant $\epsilon_2$ fixed inside the axial bore 240 at an end of the center portion 230. As with the insulation 184 of the coaxial cable 180, the dielectric bead 250 is made of any suitable dielectric, including, for example, solid polyethylene, foamed polyethylene, TEFLON, fluorinated ethylene propylene, and foamed fluorinated ethylene propylene. By way of example, the dielectric bead 250 is made of solid TEFLON.

The connector 101 also includes an inner conductor 300 within the dielectric bead 250 and extending coaxially within the axial bore 240. The inner conductor 300 has first and second end portions 310 and 320 corresponding to the first and second end portions 210 and 220 of the cylindrical outer conductor 200, and a central portion 330 corresponding to the central portion 230 of the cylindrical outer conductor 200. In the axial bore 240, the inner conductor 300 is fixed in place and electrically insulated from the cylindrical outer conductor 200 by the dielectric bead 250. The first end portions 210 and 310 interfit with the coaxial transmission line 180.

Specifically, the first end portion 310 of the inner conductor 300 has spring-type contacts for electrical contact with the center conductor 182A. As there are numerous standard means in the art to connect cables and connectors in metal-to-metal electrical contact, the electrical contact between the first end portion 310 of the inner conductor 300 and the center conductor 182A of the coaxial transmission line 180 will not be described in detail.

At the first end portion 210 of the cylindrical outer conductor 200, there is a series open circuit outer stub 212A capacitively coupled to the outer conductor 186. In this embodiment, the capacitive coupling is created by the larger inside diameter of the first end portion 210 of the cylindrical outer conductor 200 surrounding the outer conductor 186. The open circuit outer stub 212A is preferably lined with a dielectric lining 214A between the series open circuit outer stub 212A and the outer conductor 186 to maintain the proper alignment of components and to prevent electrical contact. The dielectric lining 214A is made of a suitable dielectric material such as polyethylene. By providing a dielectric material such as the dielectric lining 214A, metal-to-metal contact requiring a complex design is not required between the outer conductors of the connector and the coaxial transmission line.

Further, there is a coupling mechanism 500 to mate the coaxial transmission line 180 to the cylindrical outer conductor 200. The coupling mechanism 500 is a coupling nut made of a dielectric material such as DELRIN.

The second end portions 220 and 320 are mateable with an electrical device, including coaxial transmission lines (not pictured). By way of example, the second end portions 220 and 320 comprise a standard 7–16 DIN-type cable interface mateable with the electrical device. In another configuration, the second end portions 220 and 320 comprise a standard N-type cable interface (not pictured).

Additionally, the embodiment includes a resilient gland 510A disposed between a distal end of the dielectric lining 214A and an inside surface of the coupling mechanism 500. Specifically, the coupling mechanism 500 has a hollow inner cavity wherein a step is disposed along the inside surface. When the connector 101 is coupled to the cable 180, i.e., when the coupling mechanism 500 is tightened with respect to the cylindrical outer conductor 200 and the coaxial transmission line 180, the resilient gland 510A is compressed. As a result, the resilient gland 510A deforms and protrudes into a corrugation of the corrugated outer conductor 186 of the cable 180. In such an arrangement, the resilient gland 510A grips the corrugated outer conductor 186 of the coaxial transmission line 180 to hold the same in place and, at the same time, provides a moisture barrier.

Figure 2:
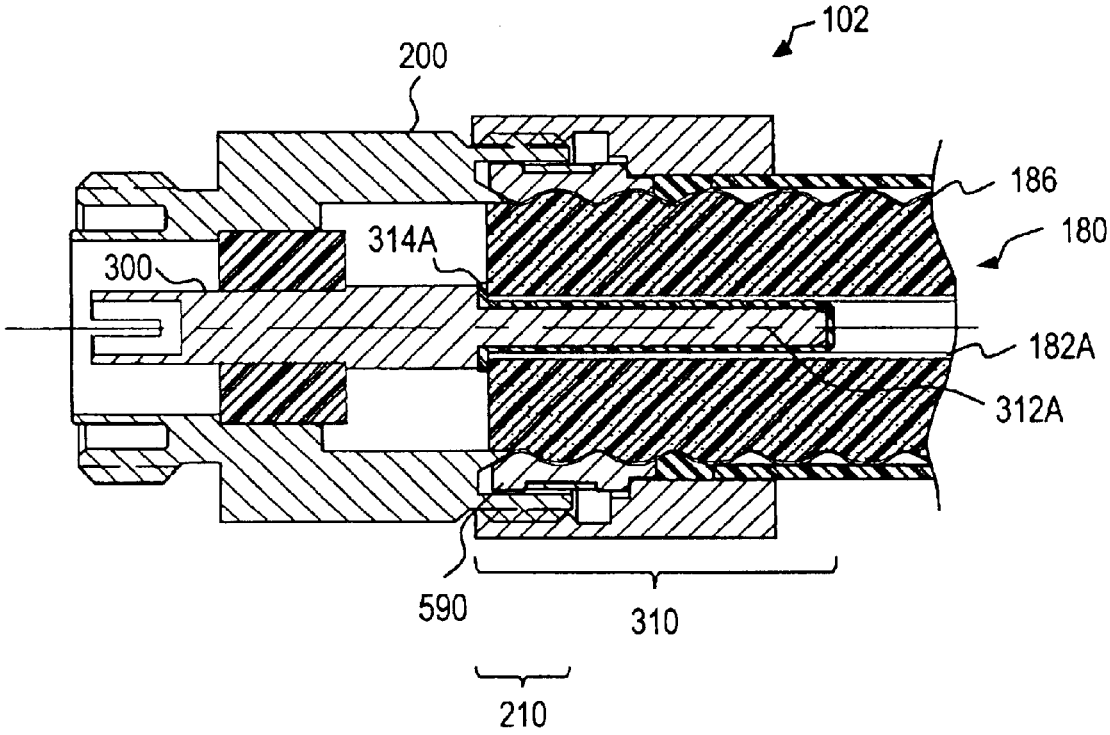
FIG. 2 is a cross sectional view of an embodiment of the invention showing a series open circuit inner stub.

FIG. 2 illustrates another embodiment of the invention showing a connector 102. This embodiment differs from the embodiment shown in FIG. 1 in that the dielectric is between the inner conductor 312A of the connector 102 and the center conductor 182A instead of the outer conductor 186 of the cable 180 and the cylindrical outer conductor 200 of the connector 101. In other words, instead of a first end portion 310 of the inner conductor 300 in electrical contact with the center conductor 182A, there is a series open circuit inner stub 312A capacitively coupled to a hollow center conductor 182A. In this embodiment, the outer diameter of the series open circuit inner stub 312A is less than the inside diameter of the hollow center conductor 182A. Preferably, there is a dielectric sleeve 314A made of a suitable material such as polyethylene to maintain the series open circuit inner stub 312A in proper alignment with respect to the hollow center conductor 182A and to prevent electrical contact. As for the first end portion 210, an electrical contact exists between the outer conductor 186 and the first end portion 210 by means known in the art. As an example of means known in the art, in FIG. 2, the clamping ferrule 590 provides direct electrical contact between the outer conductor 186 and the cylindrical outer conductor 200.

Figure 3:
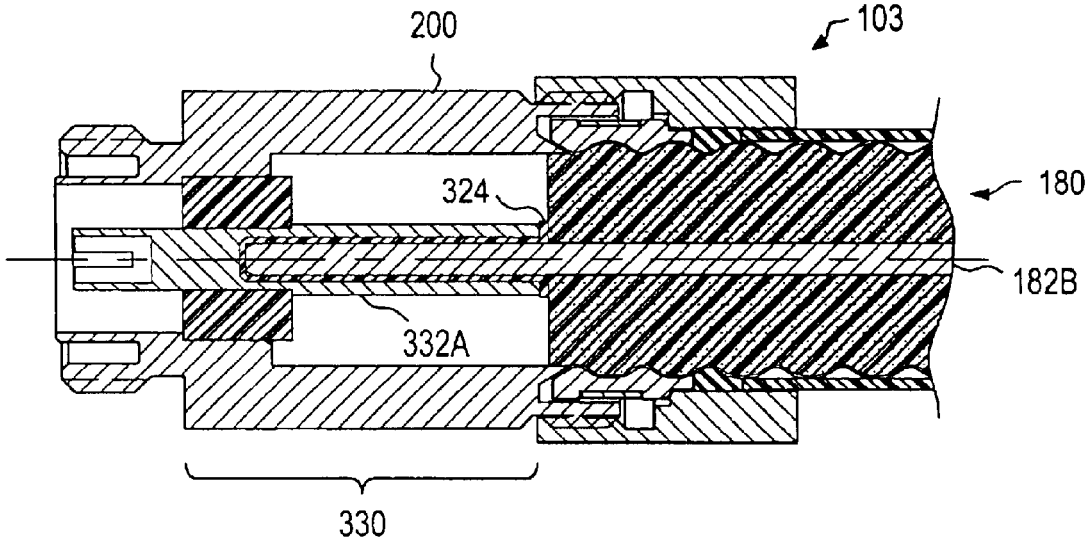
FIG. 3 is another configuration of the series open circuit inner stub.

Alternatively, in another embodiment shown in FIG. 3. This embodiment is different from the embodiment shown in FIG. 2 with respect to the following. In a connector 103, there is a series open circuit inner stub 332A at the center portion 330 of the cylindrical outer conductor 200. The series open circuit inner stub 332A has a hollow cavity in which a projecting solid end portion of an inner conductor 182B of the coaxial transmission line 180 is disposed. The inside diameter of the hollow cavity is greater than the outer diameter of the solid inner conductor 182B. A dielectric lining 324 is preferably disposed along the inside surface of the hollow cavity to maintain proper alignment of the components and to prevent electrical contact. This design is applicable to smaller coaxial transmission lines that are made with solid center conductors.

Figure 4:
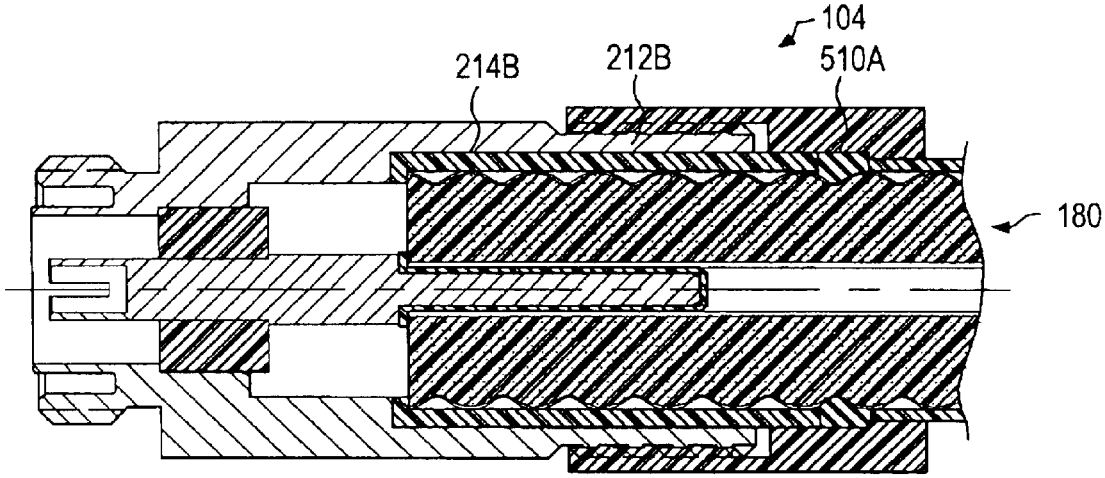
FIG. 4 is a cross sectional view of an embodiment of the invention showing series open circuit outer and inner stubs.

FIG. 4 illustrates yet another embodiment of the invention in which a dielectric is provided between the inner conductors and between the outer conductors of the connector 104 and the coaxial transmission line 180. This embodiment differs from the FIG. 2 embodiment in the following respects. This embodiment includes an open circuit outer stub 212B and a dielectric lining 214B similar to the open circuit outer stub 212A and dielectric lining 214A of FIG. 1. Further, the embodiment includes the resilient gland 510A gripping the outer conductor 186.

Figure 5:
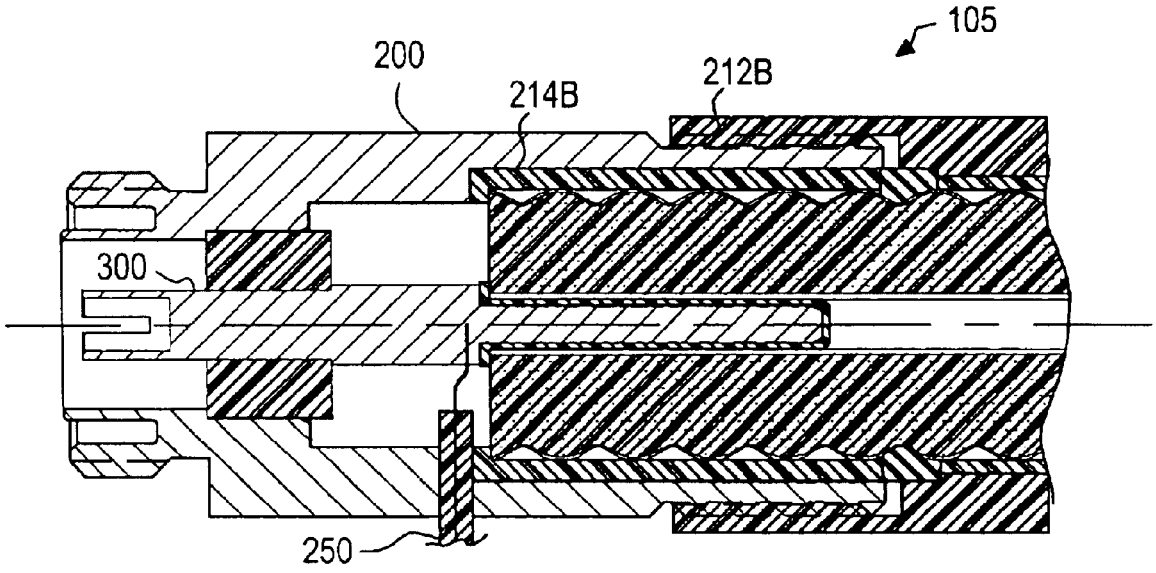
FIG. 5 is a cross sectional view of the embodiment shown in FIG. 4 further including a shunt short circuit stub.

FIG. 5 is yet another embodiment of the invention. This embodiment differs from the FIG. 4 embodiment in the following respects. There is a connector 105 showing a shunt short circuit stub 250. The shunt short circuit stub 250 is a shorted stub which provides an electrical connection between the inner conductor 300 and the cylindrical outer conductor 200. The shunt short circuit stub is disposed close to a junction located between the center portion and the first end portion for each of the cylindrical outer conductor 200 and the inner conductor 300. Often used in communication systems to prevent damage from over voltage due to lightening strikes as separate components, the shunt short circuit stub 250 as used in the connector 105 compensates for the reactance of the open circuit stubs and provides a wider bandwidth in which signal losses, i.e., VSWR, are minimized. Other tuning networks may be employed to increase bandwidth as known in the art.

Figure 6:
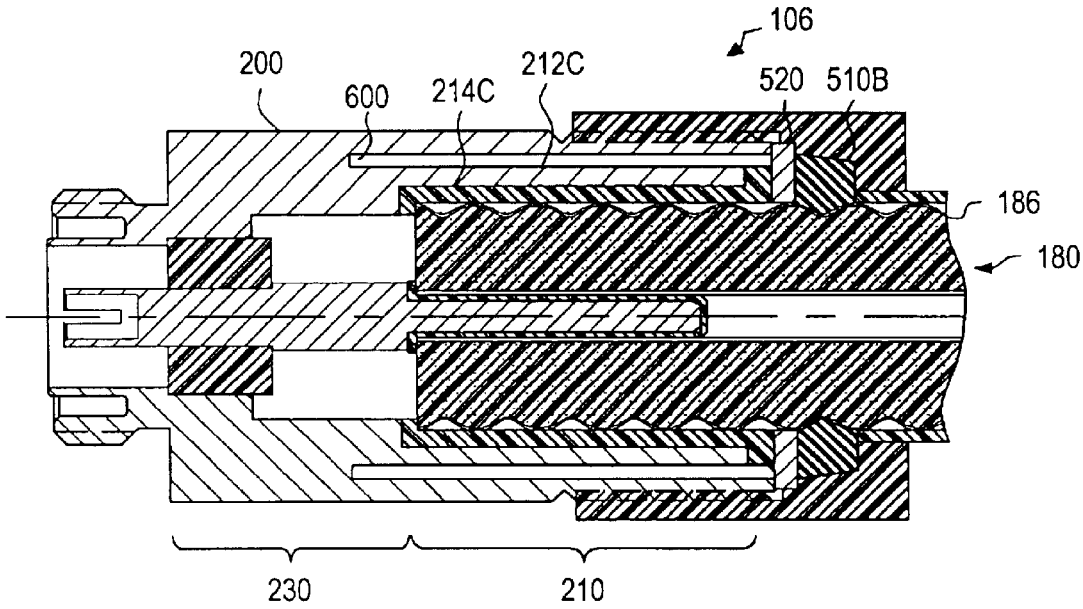
FIG. 6 is a cross sectional view of an embodiment of the invention shown in FIG. 4 further including a choke.

FIG. 6 is still yet another embodiment of the invention which differs from the embodiment described in FIG. 4 with respect to a choke. In the connector design shown in FIG. 4, a high impedance level at the series open circuit outer stub 212A is ideal. The impedance at the series open circuit outer stub 212A, however, is reduced by the radiation from the currents on the outer conductor 186 of the coaxial transmission line 180 continuing along the outer surface of the series open circuit outer stub 212A and the cylindrical outer conductor 200. To reduce the amount of radiation and, hence, to have a high impedance at the series open circuit outer stub, FIG. 6 embodiment is described.

At the open series outer stub 212C, there is an outer choke 600 extending down the length of the first end portion 210 into the cylindrical center portion 230 and surrounding the dielectric lining 214C. The choke 600 is a dielectric layer such as an air gap, preferably, or a dielectric sleeve, that is disposed within first end portion 210 of the cylindrical outer conductor 200 of the connector 106 and is electrically quarter wavelength long. With an air gap, the choke 600 is physically longer than a quarter wavelength dielectric loaded stub.

Further, there is a conductive member 520 disposed between the resilient gland 510B and the distal end of the series open circuit outer stub 212C, as shown in FIG. 6. The conductive member 520 provides a more effective open circuit outer stub 212C by creating an electrical connection between the outer conductor 186 of the cable 180, the open circuit outer stub 212C, and the outer surface of the cylindrical outer conductor 200, i.e., the outer body of the connector. The resilient gland 510B in this case is conductive to provide contact to cable 180. The conductivity of the resilient gland 510B need not be high since the resilient gland 510B is disposed at a high-impedance position where low current exists.

In an alternative embodiment, the conductive resilient gland 510B may replace the conductive member 520 depending on the conductivity of the resilient gland 510B.

Figure 7:
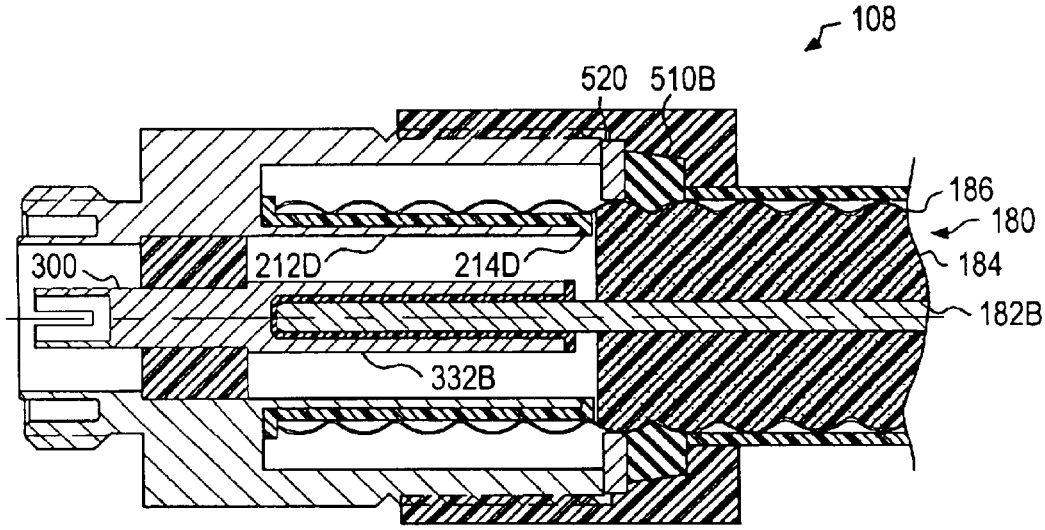
FIG. 7 is a cross sectional view of another configuration of the series open circuit outer stub.

FIG. 7 shows another embodiment realized by the insertion of a series open circuit outer stub 212D, a quarter wavelength long, and a dielectric 214D into the foam 184 of the cable 180. This embodiment differs with respect to the embodiment shown in FIG. 1 with respect to the following. Having an outside diameter less than the diameter of the outer conductor 186, the series open circuit outer stub 212D fits inside a cavity inside the foam 184. This stub design requires a special tool to cut the cavity in the foam 184. This type of tool is common in CATV cable connector installation. Alternatively, in another embodiment, the series open circuit outer stub 212D is designed to cut the cavity into the foam 184 to eliminate the need for a special tool. The center portion 332B of an inner conductor 300 has a hollow cavity to receive a protruding inner conductor 182B in a manner known in the art.

In another embodiment of the invention (not shown), a matching transformer section can be integrally incorporated into the connector 108 shown in FIG. 7 to correct for the low impedance section caused by the series open stub outer stub 212D being inserted into the cable foam 184.

It is noted that in all the embodiments described above, the length of the series open circuit stub inner conductor and the series open circuit stub outer conductor is electrically one quarter wavelength long. The exact physical length of a stub is usually determined by test since the volume of cavity created by the cable conductors and connector is a combination of dielectric and air to maintain the slip fit requirement for field installation of the connector.

This design can theoretically be used at any RF frequency, however, the invention is used for frequencies preferably above 800 MHz. In one embodiment, the invention is used for frequencies between 800 MHz and 6000 MHz. A cable for the connector embodiments described above for application in the 1850 to 1990 MHz frequency range uses a corrugated outer conductor. Such an outer conductor complicates the impedance since the effective diameter of outer conductor used to form the inner conductor of stub will be less than the maximum outer diameter of the cable. The maximum outer diameter of the outer conductor of the cable will determine the lowest impedance stub that can be realized. For example, an 8 ohm impedance can still be obtained on a ⅞ nominal cable with a 0.02 inch dielectric wall tube used at the stub.

Physically, the incorporation of the series open circuit stub conductor allow for simplified connector installation by allowing for less precise cutting of the coaxial transmission cable and less critical torque requirements to install the connector. In effect, the utilization of a non-metallic connector contact through the use of a dielectric sleeve allows the connector to be hand tightened. Furthermore, capacitively coupling both inner and outer conductors eliminates all passive intermodulation (PIM) from the most likely source while eliminating the most expensive and complicated parts of the connector. Additionally, implementation cost is reduced through the elimination of some of the expensive contact parts used in the standard coaxial connector.

The invention is described in terms of the above embodiments which are to be construed as illustrative rather than limiting, and this invention is accordingly to be broadly construed. The principle upon which this invention is based can also be applied to other frequency bands of interest.

It is contemplated that numerous modifications may be made to the present invention without departing from the spirit and scope of the invention as defined in the following claims.

What is claimed is:

1. A coaxial electrical connector for mating a coaxial transmission line having a center conductor and an outer conductor with an electrical device, said connector comprising:

a substantially cylindrical outer conductor having spaced first and second end portions, and an elongate central portion intermediate said end portions, said cylindrical outer conductor having an axial bore therethrough;

a dielectric insulator fixed within said bore at said center portion;

a coupling mechanism mating said coaxial transmission line to said substantially cylindrical outer conductor;

an inner conductor within said insulator and extending coaxially within the bore, said inner conductor having first and second end portions corresponding to said first and second end portions of said cylindrical outer conductor and a central portion corresponding to said central portion of said cylindrical outer conductor, said first end portions interfitting with the coaxial transmission line such that said first end portion of said inner conductor mates with the center conductor of the coaxial transmission line, said first end portion of said cylindrical outer conductor mates with the outer conductor of the coaxial transmission line and said second end portions being mateable with the electrical device; and a dielectric member disposed between one of (1) the first end portion of the inner conductor of the connector and the center conductor of the coaxial transmission line and (2) the first end portion of the cylindrical outer conductor of the connector and the outer conductor of the coaxial transmission line, so as to prevent a direct electrical contact therebetween.

2. The connector as claimed in claim 1, wherein said center conductor of the coaxial transmission line is a hollow center conductor, and wherein said dielectric member is disposed between the first end portion of the inner conductor and the center conductor of the coaxial transmission line, said first end portion of said inner conductor protruding inside said hollow center conductor.

3. The connector as claimed in claim 1, wherein said first end portion of said inner conductor includes a hollow portion in which said center conductor of said coaxial transmission line is received and wherein said dielectric member is disposed between the first end portion of the inner conductor and the center conductor of the coaxial transmission line.

4. The connector as claimed in claim 1, wherein said dielectric member is disposed between the first end portion of the cylindrical outer conductor and the outer conductor of the coaxial transmission line, and wherein said outer conductor of coaxial transmission line is received in said first end portion of said cylindrical outer conductor.

5. The connector as claimed in claim 1, wherein said dielectric member is disposed between the first end portion of the cylindrical cuter conductor and the outer conductor of the coaxial transmission line, and wherein said outer conductor of coaxial transmission line circumscribes said first end portion of cylindrical outer conductor.

6. The connector as claimed in claim 1, wherein said dielectric member is disposed between the first end portion of the cylindrical outer conductor of the connector and the outer conductor of the coaxial transmission line, and said coupling mechanism includes a dielectric coupling nut.

7. The connector as claimed in claim 1 wherein the dielectric member is disposed between the first end portion of the cylindrical outer conductor and the outer conductor of the coaxial transmission line, and wherein said coupling mechanism further comprises a resilient gland disposed at a distal end of the dielectric member, said resilient gland providing a moisture barrier and coupling the coaxial transmission line to the connector.

8. The connector as claimed in claim 1, wherein the first end portion of the cylindrical outer conductor includes a dielectric layer coaxial to and surrounding the dielectric member disposed between one of (1) the first end portion of the inner conductor and the center conductor and (2) the first end portion of the cylindrical outer conductor and the outer conductor of the coaxial transmission line, and the coupling mechanism includes a conductive gland disposed at a distal end of the first end portion of the cylindrical outer conductor.

9. The connector as claimed in claim 1, wherein said connector further comprises a shunt short circuit stub disposed adjacent to a junction between the center portion and the first end portion of respective cylindrical outer conductor and inner conductor, said shunt short circuit stub widening a bandwidth of transmitted signals in which return losses are minimized.

10. The connector as claimed in claim 1, wherein said connector further comprising a shunt short circuit stub disposed adjacent to a junction between the center portion and the first end portion of respective cylindrical outer conductor and inner conductor, said shunt short circuit stub compensating for a reactance of at least one of first end portion of cylindrical outer conductor and inner conductor.

11. The connector as claimed in claim 1, wherein the connector operates in a frequency between 800 MHz and 6000 MHz.

12. The connector as claimed in claim 1, wherein said dielectric member is a first dielectric member and wherein a second dielectric member is disposed between the other of (1) the first end portion of the inner conductor of the connector and the center conductor of the coaxial transmission line and (2) the first end portion of the cylindrical outer conductor and the outer conductor of the coaxial transmission line.

13. The connector as claimed in claim 12, wherein said coupling mechanism further comprises a resilient gland disposed at a distal end of the one of first and second dielectric members disposed at the outer conductor of the coaxial transmission line, said resilient gland providing a moisture barrier and coupling the coaxial transmission line to the connector.

14. The connector as claimed in claim 13, wherein the first end portion of the cylindrical outer conductor includes a dielectric layer coaxial to and surrounding the first and second dielectric members and wherein the coupling mechanism includes a conductive gland disposed at a distal end of the first end portion of the cylindrical outer conductor.

15. The connector as claimed in claim 14, wherein said connector further comprises a shunt short circuit stub disposed adjacent to a junction between the center portion and the first end portion of respective cylindrical outer conductor and inner conductor, said shunt short circuit stub widening a bandwidth of transmitted signal in which return losses are minimized.

16. A coaxial connector for mating a coaxial cable having a center conductor and an outer conductor with an electrical device, said connector comprising:

an outer connector body having an axial bore therethrough;

a dielectric insulator fixed within said bore at said center portion;

an inner conductor within said insulator and extending coaxially within the bore;

a coupling mechanism mating said coaxial cable to said outer connector body; and a dielectric sleeve disposed between one of (1) the inner conductor and the center conductor and (2) the outer connector body and the outer conductor, so as to prevent a direct electrical contact therebetween.

17. The connector as claimed in claim 16, wherein said dielectric sleeve is an inner dielectric sleeve disposed between the inner conductor and the center conductor, and wherein an outer dielectric sleeve is disposed between the outer connector body and the outer conductor, said inner and outer dielectric sleeves preventing direct electrical contact between said connector and coaxial cable, and said coupling mechanism comprises a dielectric coupling nut and a resilient gland disposed at a hollow receiving cavity of said dielectric coupling nut, said resilient gland providing a moisture barrier and coupling the coaxial cable to the connector.

18. The connector as claimed in claim 17, wherein the connector further comprises a dielectric layer coaxial to and surrounding the inner and outer dielectric sleeves and the coupling mechanism includes a conductive gland disposed at a distal end of the outer connector body and adjacent to said resilient gland.

19. The connector as claimed in claim 18, wherein said connector further comprises a shunt short circuit stub disposed adjacent to a junction between the center portion and the first end portion of each cylindrical outer conductor and inner conductor, said shunt short circuit stub compensating for a reactance of said distal end of cylindrical outer connector body and inner conductor.

20. A coaxial connector for mating a conventional coaxial cable having a center conductor and a outer conductor with an electrical device, said connector comprising:

an outer connector body having an axial bore therethrough;

a dielectric insulator fixed within said bore at said center portion;

an inner conductor within said insulator and extending coaxially within the bore;

a coupling mechanism mating said coaxial transmission cable to said outer connector body; and at least one of (1) a series open circuit outer stub coaxially disposed at an end of the outer connector body mating with the outer conductor of the coaxial cable and (2) a series open circuit inner stub coaxially disposed at an end of the inner conductor mating with the center conductor of the coaxial cable.

21. The connector as claimed in claim 20, wherein said connector comprises said series open circuit outer stub and said series open circuit inner stub, said connector further comprising a dielectric choke disposed inside an end portion of the outer connector body mating with the outer conductor of the coaxial cable, said choke coaxially surrounding said series open circuit outer and inner stubs, and said coupling mechanism comprising a conductive resilient gland disposed at a hollow receiving cavity of said coupling mechanism, said resilient gland providing a moisture barrier and coupling the coaxial cable to the connector.

* * * * *